US012473791B2

(12) United States Patent
Quero et al.

(10) Patent No.: US 12,473,791 B2
(45) Date of Patent: Nov. 18, 2025

(54) VISUALIZATION OF FISH WHILE FISHING IN A WELLBORE

(71) Applicant: Halliburton Energy Services, Inc., Houston, TX (US)

(72) Inventors: Philippe Quero, Houston, TX (US); Carlos Torres, Neiva (CO)

(73) Assignee: Halliburton Energy Services, Inc., Houston, TX (US)

( * ) Notice: Subject to any disclaimer, the term of this patent is extended or adjusted under 35 U.S.C. 154(b) by 1006 days.

(21) Appl. No.: 17/555,327

(22) Filed: Dec. 17, 2021

(65) Prior Publication Data

US 2023/0193715 A1 Jun. 22, 2023

(51) Int. Cl.
*E21B 31/18* (2006.01)
*E21B 31/03* (2006.01)

(52) U.S. Cl.
CPC ..... *E21B 31/18* (2013.01); *E21B 31/03* (2013.01)

(58) Field of Classification Search
CPC ..... E21B 31/18; E21B 31/03; E21B 41/00
See application file for complete search history.

(56) References Cited

U.S. PATENT DOCUMENTS 2,762,438 A * 9/1956 Naylor ..... E21B 31/00 166/301
3,785,690 A * 1/1974 Hutchinson ..... E21B 31/002 166/99
5,348,086 A * 9/1994 Trout ..... E21B 31/16 166/99
5,580,114 A * 12/1996 Palmer ..... E21B 31/20 294/86.15
6,244,642 B1 * 6/2001 Serafin ..... E21B 43/16 294/86.17
9,239,512 B2 * 1/2016 Foss ..... G03B 17/08
10,441,370 B2 * 10/2019 Millman ..... A61M 1/743
10,841,417 B2 * 11/2020 Diebel ..... H04M 1/0264
2009/0146442 A1 6/2009 Kelso
2019/0093471 A1 3/2019 Randle et al.
2019/0203538 A1 7/2019 Wisinger Jr. et al.
2019/0301258 A1 10/2019 Li

FOREIGN PATENT DOCUMENTS

WO 2013117998 A2 8/2013

OTHER PUBLICATIONS

International Search Report & Written Opinion in PCT/US2021/064716 dated Sep. 8, 2022.

* cited by examiner

*Primary Examiner* — Stephen A Vu
(74) *Attorney, Agent, or Firm* — The Hilton Firm PLLC

(57) ABSTRACT

Methods and apparatus for retrieving a fish from a wellbore. A method includes introducing a specialized fishing tool into the wellbore. The specialized fishing tool includes a fishing subassembly comprising a nonreflective interior, a shroud coupled to the fishing subassembly, and a camera disposed at least partially within the shroud and configured to view the interior of the fishing subassembly. The specialized fishing tool is conveyed downhole in the wellbore to a location of the fish. The fish is visualized with the camera. The fish is coupled to the fishing subassembly, and the fish is retrieved from the wellbore.

20 Claims, 4 Drawing Sheets

VISUALIZATION OF FISH WHILE FISHING IN A WELLBORE

TECHNICAL FIELD

The present disclosure relates generally to wellbore retrieval operations, and more particularly, to the use of a specialized fishing tool comprising a shroud and camera in order to visualize the fish and ensure coupling before and during retrieval of the fish.

BACKGROUND

In the drilling, completion, and operation of a well, wellbore components may be inserted and removed from the wellbore. Some examples of these components are packers, motors, pumps, sensors, sliding sleeves, liners, whipstocks, valves, cement shoe assemblies, drill bits, stuck pieces of tubing string, and the like. Fishing tools are used to retrieve these and other wellbore components, which may be referred to as a fish, by attaching to the fish securely when downhole and pulling the fish to the surface. In some fishing operations it may be difficult to attach the fishing tool to the fish and to also confirm that the fish is securely attached to the fishing tool. These complications may be due to the nature of the fishing operation being remotely downhole and in the dark and narrow wellbore. In other fishing operations, multiple trips may be made in order to visualize the fish and then retrieve it once it is located and its orientation can be determined.

Provided are improvements to wellbore retrieval operations, through the use of a specialized fishing tool comprising a shroud and camera in order to visualize the fish and ensure coupling before and during retrieval of the fish.

BRIEF DESCRIPTION OF THE DRAWINGS

Illustrative examples of the present disclosure are described in detail below with reference to the attached drawing figures, which are incorporated by reference herein, and wherein.

Figure 1:
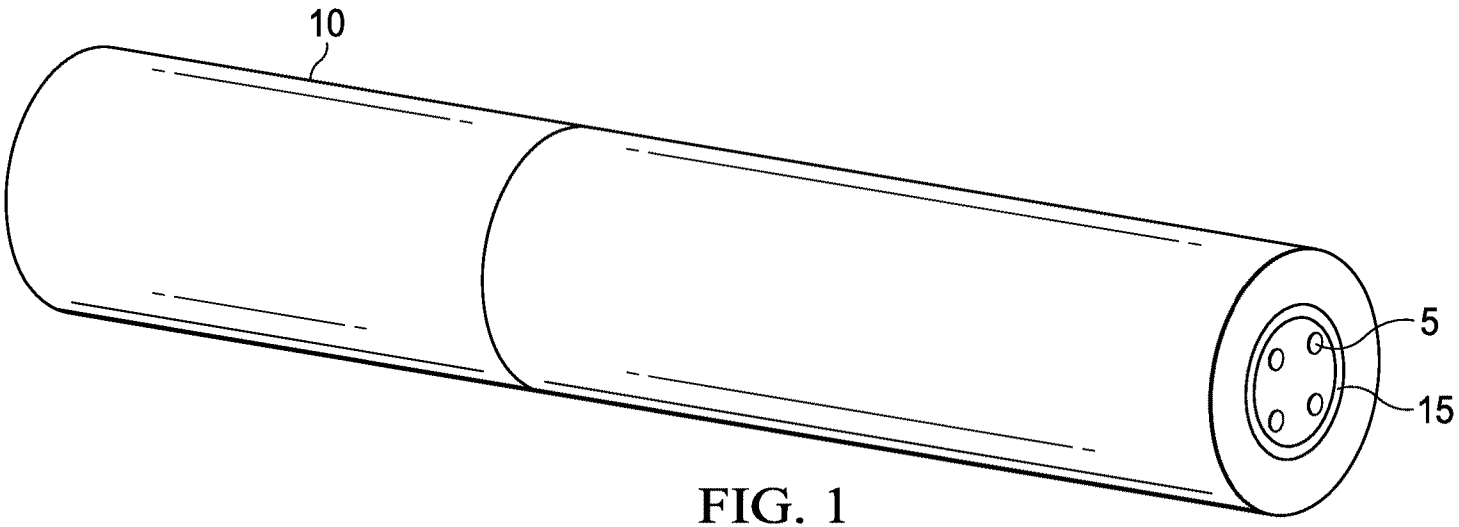
FIG. 1 illustrates a perspective view of a camera attached to a top tool assembly in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore retrieval operations, and more particularly, to the use of a specialized fishing tool comprising a shroud and camera in order to visualize the fish and ensure coupling before and during retrieval of the fish.

In the following detailed description of several illustrative examples, reference is made to the accompanying drawings that form a part hereof, and in which is shown by way of illustration, examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The examples described herein relate to the use of a specialized fishing tool comprising a shroud and camera in order to visualize the fish and ensure coupling before and during retrieval of the fish. The fishing tool may reduce the difficulty of the retrieval operation by allowing real-time visualization of the fish so that the fishing tool may be manipulated to couple to the fish successfully. Another advantage is that the camera allows for continuous confirmation during the retrieval operation that the fish has remained coupled to the fishing tool as the fishing tool is pulled uphole. As a further advantage, the fishing tool comprises a shroud which shields the camera, couples the fishing tool to the shroud, and allows for the flow of a fluid downhole. The fluid may be used to clean the camera, to clean the fish, and to ensure a clear field of vision for the camera as it is conveyed downhole. An additional advantage is that the camera comprises lights (e.g., light-emitting diodes) to provide clear visualization of the fish in the wellbore. A further advantage is that the internal structure of the fishing tool may be covered with a non-reflective material to ensure that the lights do not reflect off the fishing tool surface and impair visualization of the fish. An additionally advantage is that the fishing tool is able to retrieve the fish in one trip downhole as it can visualize the fish, couple to the fish, and ensure that the coupled arrangement is maintained as the fishing tool is conveyed uphole.

FIG. 1 illustrates a perspective view of a camera 5 attached to a top tool assembly 10. The camera 5 may comprise any down-facing camera sufficient for use in a wellbore. The camera 5 may provide full color, high resolution video and/or still images in real time. Examples of the camera 5 types include, but are not limited to, cameras with down view capabilities, cameras with flowthrough capabilities, cameras without flowthrough capabilities, combinations of camera types, and any other camera types suitable for downhole use. The camera 5 may be configured to take still images or video and transmit the same to the surface via a wired connection (e.g., fiber optic or electric) or wireless connection. If a wired connection is used, the wired connection may be conveyed to the surface through an internal portion of the top tool assembly 10. The camera 5 may transmit live videos or still pictures to the surface of a fish disposed within the wellbore. The camera 5 may also be used to inspect the interior of the casing or the wellbore. The camera 5 may comprise adjustable apertures which may be adjusted via a control signal from the surface. The camera 5 may comprise a light 15 which may be used to illuminate the fish. The light 15 may be any species of light 15 sufficient for wellbore use. Examples of the light 15 include, but are not limited to, a light-emitting diode or any such lighting system sufficient for downhole use. In some optional examples, a plurality of lights 15 may be used. In some optional examples, the light 15 may be controllable via a control signal transmitted from the surface. The light 15 may be adjusted to increase or decrease the brightness as well as to turn the light 15 on and off.

With continued reference to FIG. 1, the top tool assembly 10 may be coupled to the camera 5 and the shroud (discussed below). The top tool assembly 10 may also contain control lines for the camera 5 and the light 15. The top tool assembly 10 may also contain power lines for the camera 5 and the light 15. In some examples, the control and power lines may be combined into a hybrid line contained within the top tool assembly 10. The top tool assembly 10 may also comprise hydraulic lines to convey a fluid in the annular space between the camera 5 and shroud. In some optional examples, the top tool assembly 10 may comprise an electric wire or fiber connection to couple the camera to upstream equipment. In other optional examples, the top tool assembly 10 may also comprise sensors to correlate and acquire information such as load and pressure. In still other optional examples, the top tool assembly 10 may comprise a cable head and/or anchoring system.

Figure 2:
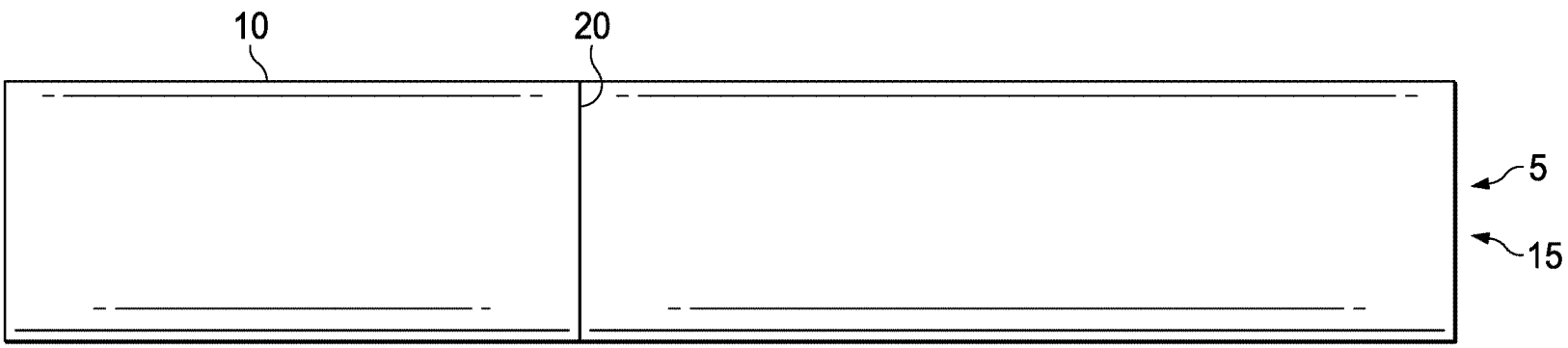
FIG. 2 is a side view of the camera and the top tool assembly of FIG. 1 in accordance with one or more examples described herein.

FIG. 2 is a side view of the camera 5 and the top tool assembly 10. The camera 5 may be coupled to the top tool assembly 10 via any sufficient coupling mechanism 20. Examples of coupling mechanism 20 includes bolted connections, threaded connections, spring-locked connections, quick connections, and the like.

Figure 3:
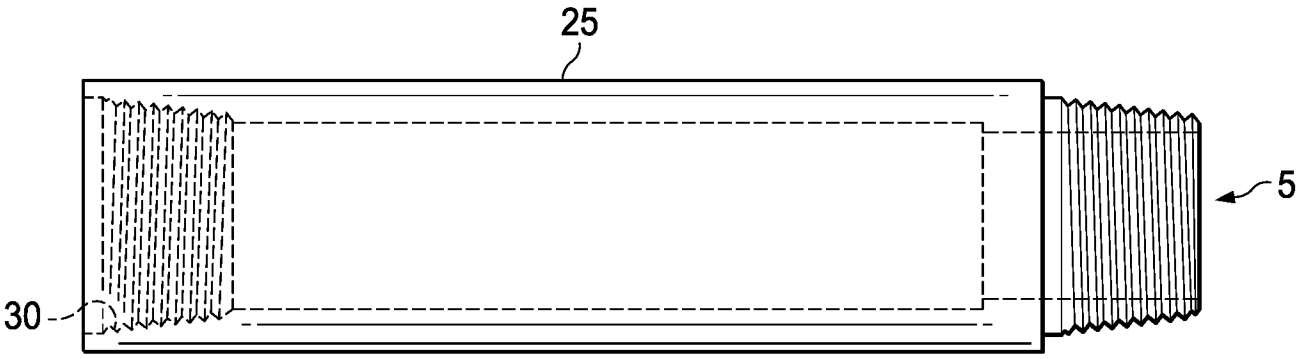
FIG. 3 is a side view of a shroud in accordance with one or more examples described herein.

FIG. 3 is a side view of the shroud 25. The shroud 25 couples to the top tool assembly (e.g., top tool assembly 10 illustrated in FIGS. 1 and 2). The shroud 25 may be coupled to the top tool assembly 10 via any sufficient coupling mechanism 30. Examples of coupling mechanism 30 includes bolted connections, threaded connections, spring-locked connections, and the like. The shroud 25 is disposed over the camera 5 to protect the camera 5 from damage as it is conveyed downhole. An annular path exists between the shroud 25 and the camera 5 to allow fluid flow therethrough. The shroud 25 may be composed of a variety of materials including, but not limited to, steel, stainless steel, nickel-chromium alloys, plastic, aluminum, nickel, carbon fiber, fiberglass, alloys thereof, or combinations thereof. The shroud 25 may be machined or manufactured by 3D printing or other types of additive manufacturing. In some optional examples, the shroud 25 may be painted or covered with a non-reflective material. The shroud 25 may also be inherently non-reflective if made from a non-reflective metal. The terminal end of the shroud 25 couples to the fishing tool (discussed below).

Figure 4:
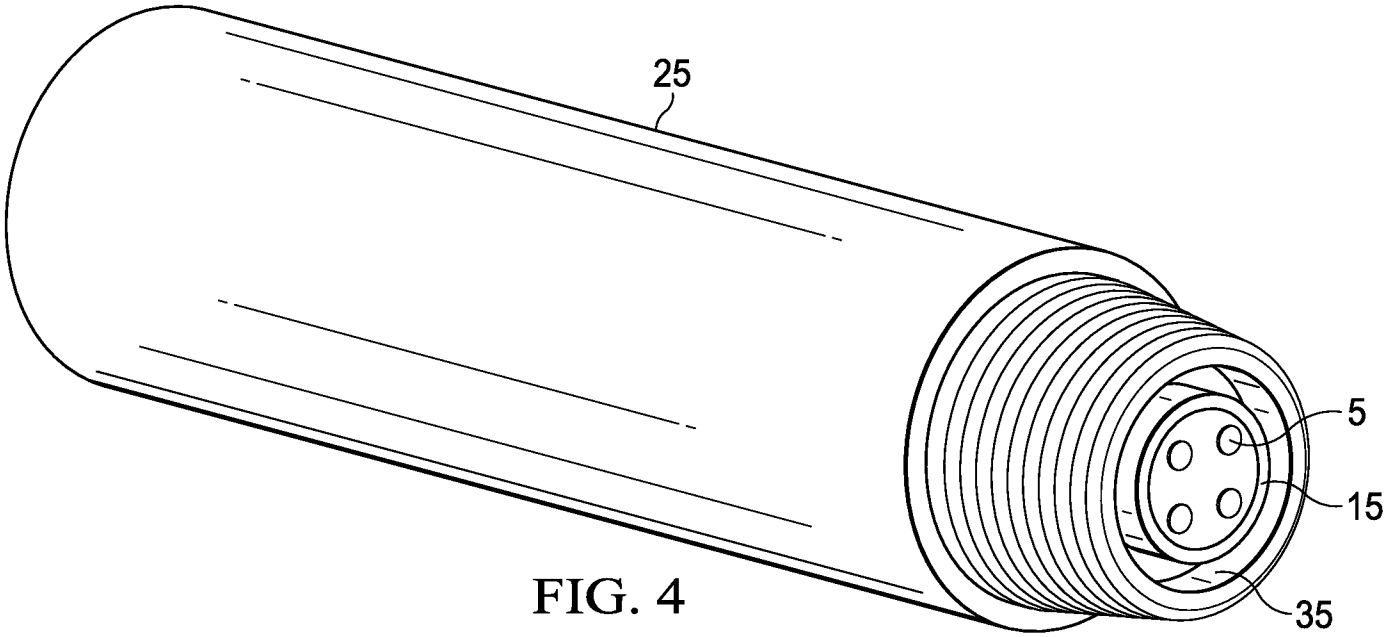
FIG. 4 illustrates a perspective view of the shroud of FIG. 3 when disposed over the camera in accordance with one or more examples described herein.

FIG. 4 illustrates a perspective view of the shroud 25 disposed over the camera 5. As illustrated, the shroud 25 covers and protects the camera 5. Light 15 is also partially covered by the shroud 25, but the area in front of the light 15 is exposed to allow the light 15 to shine forward. An annular path 35 is disposed between the shroud 25 and the camera 5 to allow fluid to flow therethrough. The fluid may be conveyed downhole via hydraulic lines disposed within the top tool assembly (e.g., top tool assembly 10 as illustrated in FIGS. 1 and 2 and discussed above) and run from the surface. The fluid may be used to remove debris from the camera 5 to keep the picture resolution high and unobscured. Additionally, the fluid may be used to remove debris from the fish to increase the chance of the fishing tool successfully coupling with the fish. The fluid may be any type of fluid sufficient for these purposes and may include freshwater, brines, organic solvents, or heavier cleaning fluids. The fluid may be changed on the fly by an operator on the surface if, for example, the fluid is proving to be insufficient for removing the debris from the camera 5 or the fish.

Figure 5:
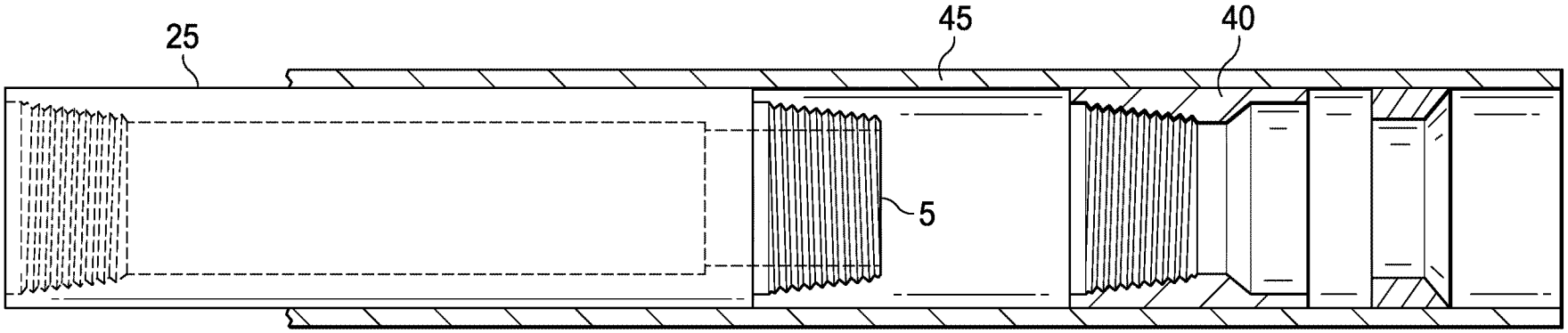
FIG. 5 is a side view of a specialized fishing tool and a cross-section of a fishing subassembly in accordance with one or more examples described herein.

FIG. 5 is a side view of a specialized fishing tool, generally 45, and also illustrates a cross-section of the fishing subassembly 40. The specialized fishing tool 45 comprises the camera 5 and the shroud 25 as illustrated in FIGS. 1-4 and discussed above as well as the fishing subassembly 40. A terminal end of the shroud 25 is coupled to a terminal end of the fishing subassembly 40 via any sufficient coupling mechanism including, but not limited to, bolted connections, threaded connections, spring-locked connections, and the like. The camera 5 is disposed within the end of the fishing subassembly 40. The interior of the fishing subassembly 40 may be coated with a non-reflective material such as a non-reflective paint. Alternatively, the interior of the fishing subassembly 40 may comprise a non-reflective material. Fishing subassembly 40 may comprise any fishing mechanism sufficient to couple to and retain a fish such that it may be captured and transported to the surface. Examples of the fishing mechanism include, but are not limited to, overshot tools, flow-activated overshot tools, mechanical overshot tools, centralizer tools, pulling tools, jar tools, hammer tools, running tools, or combinations of tools.

Figure 6:
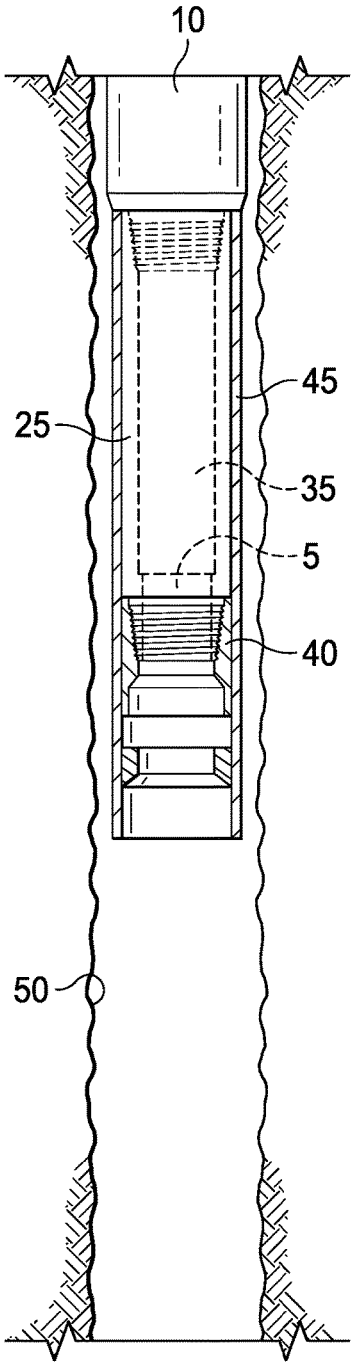
FIG. 6 illustrates a method for capturing a fish in accordance with the examples disclosed herein.

FIG. 6 illustrates a method for capturing a fish in accordance with the examples disclosed herein. The specialized fishing tool 45 is illustrated in its run-in-hole configuration as it is lowered downhole into a wellbore 50. The specialized fishing tool 45 is lowered into the wellbore 50 via the top tool assembly 10 which may be extended downhole from the surface and/or conveyed via wireline or other mechanism. The specialized fishing tool 45 may be lowered within the wellbore 50 until it encounters the fish 55. The camera 5 allows viewing of the interior of the wellbore 50 as well as the fish 55 when the fish 55 is encountered. Lights (e.g., light 15 as illustrated in FIGS. 1 and 4) may illuminate the area to enhance viewing. The interior of the fishing subassembly 40 may comprise a non-reflective material to enhance viewing. The camera 5 may transmit video and/or still images in real-time to an operator on the surface as the specialized fishing tool 45 is conveyed downhole. Should the camera 5 become obscured from debris within the wellbore 50, fluid may be pumped through annular path 35 to clean the area and remove the debris so that the camera 5 may remain unobscured.

Figure 7:
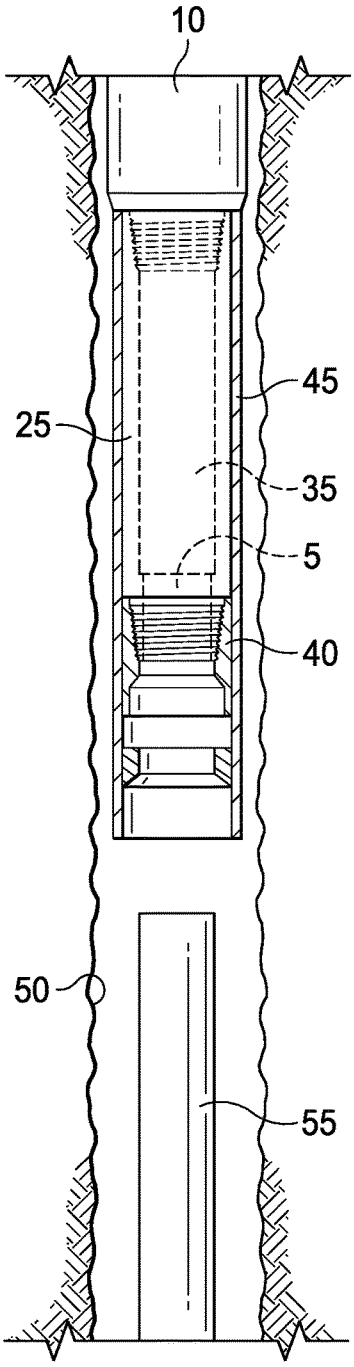
FIG. 7 illustrates the method for capturing a fish of FIG. 6 as the specialized fishing tool encounters the fish in accordance with the examples disclosed herein.

FIG. 7 illustrates the method for capturing a fish of FIG. 6 as the specialized fishing tool 45 encounters a fish 55 in accordance with the examples disclosed herein. The specialized fishing tool 45 may be conveyed downhole within wellbore 50 until it encounters the fish 55. The fish 55 may be viewed with the camera 5. The operator may view the fish 55 in real-time as it is encountered downhole by the specialized fishing tool 45. Upon viewing of the fish 55, the operator may elect to slow down or halt the downhole conveyance of the specialized fishing tool 45. In some optional embodiments, the operator may elect to pump a fluid through the annular path 35 to remove any debris from the fish 55 to increase the probability of the fishing subassembly 40 successfully coupling with the fish 55.

The fish 55 may be any wellbore tool or component of the same including packers, motors, pumps, sensors, sliding sleeves, liners, whipstocks, valves, cement shoe assemblies, drill bits, and the like. Alternatively, the fish 55 may comprise stuck pieces of tubing string, casing, wellbore conduits, dislodged pieces of the wellbore that form blockages, etc.

Figure 8:
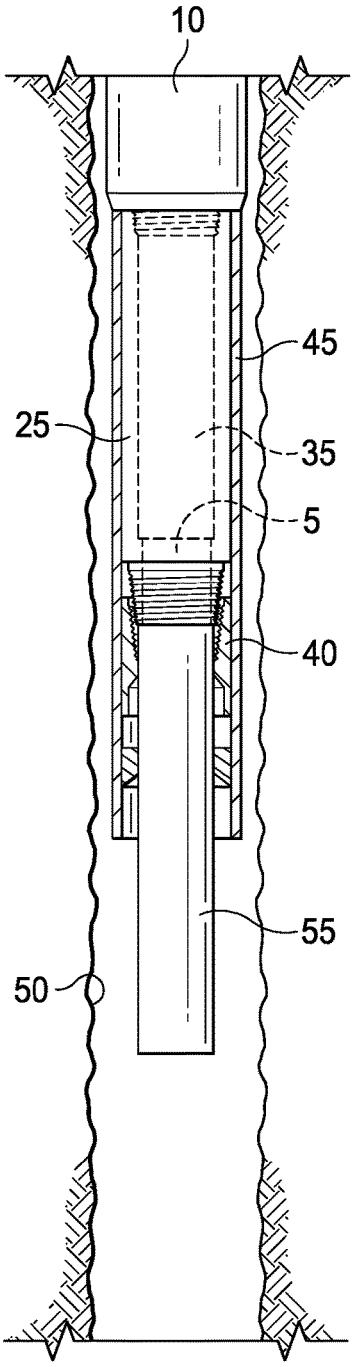
FIG. 8 illustrates the method for capturing the fish of FIGS. 6 and 7 as the specialized fishing tool couples to the fish in accordance with the examples disclosed herein.

FIG. 8 illustrates the method for capturing the fish of FIGS. 6 and 7 as the specialized fishing tool 45 couples to the fish 55 in accordance with the examples disclosed herein. As the specialized fishing tool 45 is conveyed downhole, it may encounter fish 55. The operator is able to view fish 55 in real-time during the conveyance. Upon encountering the fish 55, the operator may decide to flush the fish 55 with a fluid if so desired. The operator may then contact the fish 55 with the fishing subassembly 40 of the specialized fishing tool 45 to couple the fish 55 to the specialized fishing tool 45. Once the fish 55 is attached, the specialized fishing tool 45 may be conveyed uphole, for example, by retracting a wireline. As the specialized fishing tool 45 is conveyed uphole, the operator is able to view the coupled fish 55 in real-time to ensure that the fish 55 is still coupled to the fishing subassembly 40. Should the fish 55 detach, the operator may halt the upward conveyance of the specialized fishing tool 45 and attempt a reconnection. If successful, the specialized fishing tool 45 may be pulled uphole again and the fish 55 continually monitored.

With reference to FIGS. 6-8, the specialized fishing tool 45 is able to achieve capture of the fish 55 in a single operation as the visualization and capture operations are combined.

There is no need for a separate visualization operation prior to insertion of the specialized fishing tool 45 and a camera 5 may not be sent downhole to visualize the fish 55 in a separate operation prior to insertion of the specialized fishing tool 45. This single-trip process reduces overall operation time. Moreover, should the fish 55 uncouple from the specialized fishing tool 45 during capture, there is no need to remove the specialized fishing tool 45 to perform a separate visualization operation as the camera 5 is already present and may visualize the decoupled fish 55 to recouple it in the same single-trip operation.

It is to be understood that the specialized fishing tool 45 and its components as depicted in FIGS. 1-8 are only one possible configuration of the specialized fishing tool 45. The individual pieces of the specialized fishing tool 45 may be rearranged as would be readily apparent to one of ordinary skill in the art. As such, it is to be recognized that the specialized fishing tool 45 is merely exemplary in nature, and various additional configurations may be used that have not necessarily been depicted in FIGS. 1-8 in the interest of clarity. Moreover, non-limiting additional components may be present, including, but not limited to, valves, condensers, adapters, joints, gauges, sensors, compressors, pressure controllers, pressure sensors, flow rate controllers, flow rate sensors, temperature sensors, and the like. As such, it should be clearly understood that the example illustrated by FIGS. 1-8 is merely a general application of the principles of this disclosure in practice, and a wide variety of other examples are possible. Therefore, the scope of this disclosure is not limited in any manner to the details of FIGS. 1-8 as described herein.

It is to be recognized that the specialized fishing tool may also directly or indirectly affect the various downhole equipment and tools that may contact the specialized fishing tool disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the apparatus, methods, and systems generally described above and depicted in FIGS. 1-8.

Provided are methods for retrieving a fish from a wellbore. An example method comprises introducing a specialized fishing tool into the wellbore, the specialized fishing tool comprises a fishing subassembly comprising a nonreflective interior, a shroud coupled to the fishing subassembly, and a camera disposed at least partially within the shroud and configured to view the interior of the fishing subassembly. The method further comprises conveying the specialized fishing tool downhole in the wellbore to a location of the fish, visualizing the fish with the camera, coupling the fish to the fishing subassembly, and retrieving the fish from the wellbore.

Additionally or alternatively, the method may include one or more of the following features individually or in combination. The fish may be contacted with a fluid ejected from the specialized fishing tool prior to coupling the fish to the fishing subassembly. The fish may be visualized by the camera as it is being retrieved from the wellbore. There may be no prior operation to send a camera to visualize the fish prior to the introducing the specialized fishing tool into the wellbore. The specialized fishing tool may further comprise at least one light. The light's brightness may be controlled via a control signal conveyed from an operator. The camera may be controlled via a control signal conveyed from an operator. There may be an annular space between the shroud and the camera configured to allow fluid flow therethrough. The camera may be selected from the group consisting of a camera with down view capability, a camera with flowthrough capability, a camera without flowthrough capability, and any combination thereof. The shroud may comprise a material selected from the group consisting of steel, stainless steel, a nickel-chromium alloy, plastic, aluminum, nickel, carbon fiber, fiberglass, alloys thereof, and any combination thereof. The fishing subassembly may comprise a fishing mechanism selected from the group consisting of an overshot tool, a flow-activated overshot tool, a mechanical overshot tool, a centralizer tool, a pulling tool, a jar tool, a hammer tool, a running tool, and any combination thereof. The nonreflective interior of the fishing subassembly may comprise a nonreflective paint.

Provided is a specialized fishing tool. An example specialized fishing tool comprises a fishing subassembly comprising a nonreflective interior, a shroud coupled to the fishing subassembly, and a camera disposed at least partially within the shroud and configured to view the interior of the fishing subassembly.

Additionally or alternatively, the specialized fishing tool may include one or more of the following features individually or in combination. The specialized fishing tool may further comprise at least one light. The light's brightness may be controlled via a control signal conveyed from an operator. The specialized fishing tool may further comprise an annular space between the shroud and the camera configured to allow fluid flow therethrough. The camera may be selected from the group consisting of a camera with down view capability, a camera with flowthrough capability, a camera without flowthrough capability, and any combination thereof. The camera may be controlled via a control signal conveyed from an operator. The shroud may comprise a material selected from the group consisting of steel, stainless steel, a nickel-chromium alloy, plastic, aluminum, nickel, carbon fiber, fiberglass, alloys thereof, and any combination thereof. The fishing subassembly may comprise a fishing mechanism selected from the group consisting of an overshot tool, a flow-activated overshot tool, a mechanical overshot tool, a centralizer tool, a pulling tool, a jar tool, a hammer tool, a running tool, and any combination thereof. The nonreflective interior of the fishing subassembly may comprise a nonreflective paint.

Provided are systems for retrieving a fish from a wellbore. An example system comprises a specialized fishing tool comprising: a fishing subassembly comprising a nonreflective interior, a shroud coupled to the fishing subassembly, and a camera disposed at least partially within the shroud and configured to view the interior of the fishing subassembly. The system further comprises a top tool assembly coupled to the shroud.

Additionally or alternatively, the system may include one or more of the following features individually or in combination. The specialized fishing tool may further comprise at least one light. The light's brightness may be controlled via a control signal conveyed from an operator. The specialized fishing tool may further comprise an annular space between the shroud and the camera configured to allow fluid flow therethrough. The camera may be selected from the group consisting of a camera with down view capability, a camera with flowthrough capability, a camera without flowthrough capability, and any combination thereof. The camera may be controlled via a control signal conveyed from an operator. The shroud may comprise a material selected from the group consisting of steel, stainless steel, a nickel-chromium alloy, plastic, aluminum, nickel, carbon fiber, fiberglass, alloys thereof, and any combination thereof. The fishing subassembly may comprise a fishing mechanism selected from the group consisting of an overshot tool, a flow-activated overshot tool, a mechanical overshot tool, a centralizer tool, a pulling tool, a jar tool, a hammer tool, a running tool, and any combination thereof. The nonreflective interior of the fishing subassembly may comprise a nonreflective paint. The system may further comprise a wireline coupled to the top tool assembly.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A specialized fishing tool comprising:

a fishing subassembly comprising a nonreflective interior and a fishing mechanism selected from the group consisting of an overshot tool, a flow-activated overshot tool, a mechanical overshot tool, a centralizer tool, a pulling tool, a jar tool, a hammer tool, a running tool, and any combination thereof, a shroud coupled to the fishing subassembly, and a camera disposed at least partially within the shroud and configured to view the nonreflective interior of the fishing subassembly.

2. The specialized fishing tool of claim 1, further comprising at least one light.

3. The specialized fishing tool of claim 2, wherein the light's brightness is controlled via a control signal conveyed from an operator.

4. The specialized fishing tool of claim 1, further comprising an annular space between the shroud and the camera configured to allow fluid flow therethrough.

5. The specialized fishing tool of claim 1, wherein the camera is selected from the group consisting of a camera with down view capability, a camera with flowthrough capability, a camera without flowthrough capability, and any combination thereof.

6. The specialized fishing tool of claim 1, wherein the camera is controlled via a control signal conveyed from an operator.

7. The specialized fishing tool of claim 1, wherein the shroud comprises a material selected from the group consisting of steel, stainless steel, a nickel-chromium alloy, plastic, aluminum, nickel, carbon fiber, fiberglass, alloys thereof, and any combination thereof.

8. The specialized fishing tool of claim 1, wherein the nonreflective interior of the fishing subassembly comprises a nonreflective paint.

9. A method for retrieving a fish from a wellbore, the method comprising: introducing a specialized fishing tool into the wellbore, the specialized fishing tool comprising:

a fishing subassembly comprising a nonreflective interior, a shroud coupled to the fishing subassembly, and a camera disposed at least partially within the shroud and configured to view the nonreflective interior of the fishing subassembly, conveying the specialized fishing tool downhole in the wellbore to a location of the fish, visualizing the fish with the camera, coupling the fish to the fishing subassembly, and retrieving the fish from the wellbore.

10. The method of claim 9, wherein the fish is contacted with a fluid ejected from the specialized fishing tool prior to coupling the fish to the fishing subassembly.

11. The method of claim 9, wherein the fish is visualized by the camera as it is being retrieved from the wellbore.

12. The method of claim 9, wherein there is no prior operation to send a camera to visualize the fish prior to the introducing the specialized fishing tool into the wellbore.

13. The method of claim 10, wherein the specialized fishing tool further comprises at least one light.

14. The method of claim 13, wherein the light's brightness is controlled via a control signal conveyed from an operator.

15. The method of claim 9, wherein the camera is controlled via a control signal conveyed from an operator.

16. A system for retrieving a fish from a wellbore, the system comprising:

a specialized fishing tool comprising:

a fishing subassembly comprising a nonreflective interior and a fishing mechanism selected from the group consisting of an overshot tool, a flow-activated overshot tool, a mechanical overshot tool, a centralizer tool, a pulling tool, a jar tool, a hammer tool, a running tool, and any combination thereof, a shroud coupled to the fishing subassembly, and a camera disposed at least partially within the shroud and configured to view the interior of the fishing subassembly, and a top tool assembly coupled to the shroud.

17. The system of claim 16, further comprising a wireline coupled to the top tool assembly.

18. The system of claim 16, wherein the specialized fishing tool further comprises at least one light, and wherein the light's brightness is controlled via a control signal conveyed from an operator.

19. The system of claim 16, wherein the camera is controlled via a control signal conveyed from an operator.

20. The system of claim 16, wherein the camera is selected from the group consisting of a camera with down view capability, a camera with flowthrough capability, a camera without flowthrough capability, and any combination thereof.

* * * * *